United States Patent [19]

Akins

[11] Patent Number: 4,594,832

[45] Date of Patent: Jun. 17, 1986

[54] SPACER

[76] Inventor: Dorman C. Akins, 3510 Norris Dr., Houston, Tex. 77025

[21] Appl. No.: 522,001

[22] Filed: Aug. 11, 1983

[51] Int. Cl.[4] ..... E04B 1/38; E04B 5/52

[52] U.S. Cl. ..... 52/715; 52/488; 52/664; 52/668

[58] Field of Search ..... 52/712, 715, 484, 39, 52/488, 489, 486, 668, 664

[56] References Cited

U.S. PATENT DOCUMENTS

| | | | |
|---|---|---|---|
| 2,946,414 | 7/1960 | Gordon et al. | 52/484 |
| 3,352,071 | 11/1967 | Sutter | 52/484 |
| 3,374,596 | 3/1968 | O'Brien et al. | 52/664 |
| 3,511,012 | 5/1970 | Brady | 52/484 |
| 3,768,224 | 10/1973 | Curtis | 52/668 |
| 3,797,192 | 3/1974 | De Jonge | 52/484 |
| 3,798,865 | 3/1974 | Curtis | 52/715 |
| 4,011,707 | 3/1977 | Nute, Jr. | 52/664 |
| 4,122,762 | 10/1978 | Williams | 52/39 |

*Primary Examiner*—Carl D. Friedman
*Assistant Examiner*—Michael Safavi
*Attorney, Agent, or Firm*—Robert W. B. Dickerson

[57] ABSTRACT

Device for aligning main runners in a diffuser system, comprising a flat base, upturned tabs at each end of the base, and a slotted lug depending perpendicularly from each tab, such lugs adapted to releasably mate with main runner slots.

2 Claims, 3 Drawing Figures

SPACER

BACKGROUND OF THE INVENTION

Commercial construction systems have long contemplated the installation of acoustical ceilings. Positioned within, or forming a part of, such ceiling may be a number of items, such as light fixtures, sprinkler nozzles, and diffusers for cooling systems. Such diffusers provide openings for cool air produced by the system, such openings oftentimes being positioned adjacent a window. A diffuser normally is positioned intermediate a pair of spaced, parallel, main runners. These runners need be kept parallel for a number of reasons, including geometric symmetry and ease of fixture placement. Spacers have been developed in the past for fixidly positioning main runners in parallel relationship, and thereby stabilizing the diffuser openings. The present invention represents a spacer improved over the prior art in permitting both economy of fabrication and positive parallel alignment of the main runners.

SUMMARY OF THE INVENTION

The spacer of this invention includes a rigid central body, having upturned legs at each end. One leg may be of slightly lesser width than the other. Each leg has a substantially perpendicular ear depending therefrom, extending away from the central body. Each of the two ears includes a cut-out or slot adjacent the ear-leg juncture for locking purposes with a slot in the main runners to which the spacer is adapted to be fixed.

DESCRIPTION OF A PREFERRED EMBODIMENT

Figure 3:
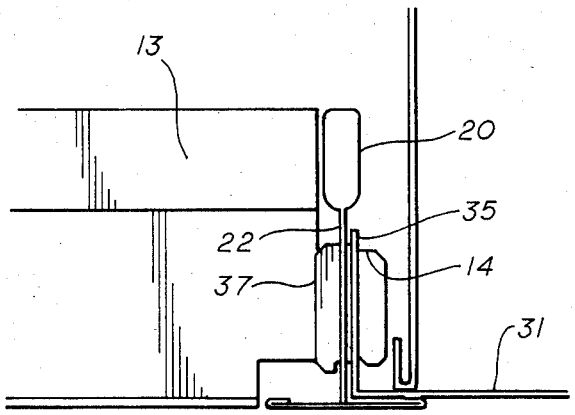
FIG. 3 is an end elevation of the spacer locked into position relative to a pair of spaced main runners.

Oftentimes ceilings are suspended from the building structual support, such as beams 10, by wires 12 attached to the beam by clips 11, at one end of the wire, said wires being linked at their other ends to main runners 20. Such main runners would be supported by cross tees 13 (see FIG. 3), forming a grid. Such cross tees would be affixed to the main runners by cross tee lugs 14 extending through slots 21 in the main runners. Acoustical squares are fitted, in a known manner, to the bases of the main runners and cross tees. Throughout most of the grid, the main runners are spaced at some even interval, such as at four foot center separations. For the fixing of slot diffuser openings, often-times adjacent the exterior wall windows, adjacent main runners are positioned substantially closer together, in the range of 2"–6". The spacer 30 of this invention is fitted within, and normal to a pair of said closely adjacent main runners 20.

Figure 1:
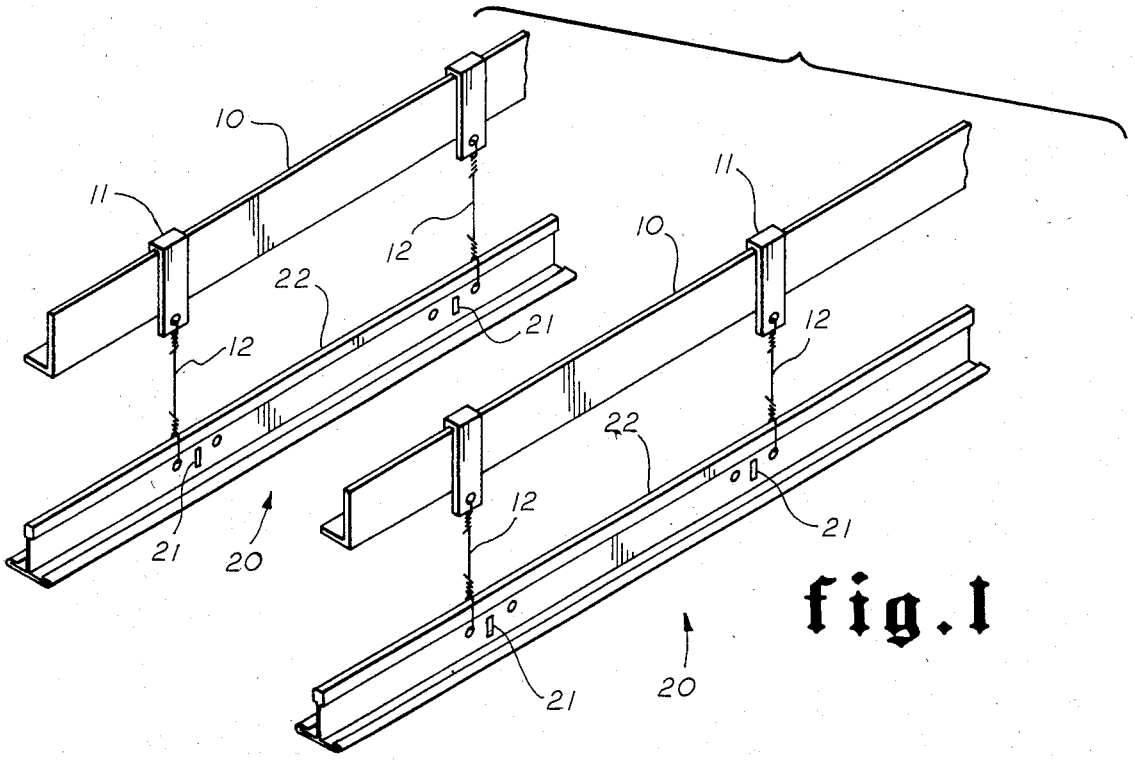
FIG. 1 is a somewhat schematic perspective of a portion of a building ceiling, illustrating a typical means of construction.
Figure 2:
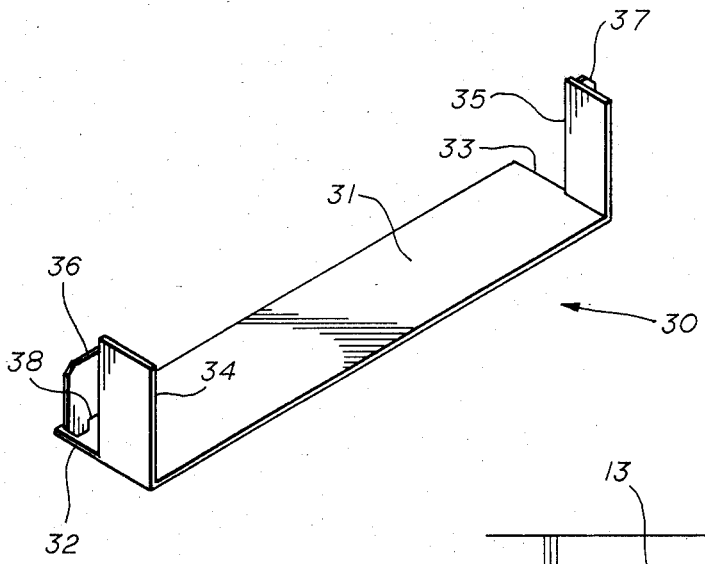
FIG. 2 is a perspective of the spacer of this invention.

Looking now at FIG. 2, spacer 30 includes a rigid, flat central body, plate or panel 31. At opposite ends 32, 33 of body portion 31, tabs or legs 34, 35 are upturned and depend perpendicularly therefrom. Each leg has a perpendicularly outturned ear, 36, 37 intermediate the legs juncture with body 31 and the leg's opposite edge. Each said ear has a cutout, or notch 38 along its edge nearest body 31, adjacent its respective leg (only one such notch being shown in FIG. 2). Each spacer is positioned intermediate and substantially perpendicular to the aforementioned pair of closely adjacent main runners, and connected thereto, with legs 34, 35 positioned adjacent the webs 22 of the respective main runners. The connection occurs by virtue of ears 36, 37 passing through slots 21 in the main runners and being urged downwardly so that slots 38 lock the spacer to the main runner. It should be noted that one of the spacer legs, such as 35, is of slightly lesser width than the other. This permits cross tee lug 14, of an adjacent cross tee, to be secured to a main runner through the same slot 21.

It will be seen that a plurality of spacers of this invention, spaced throughout the length of the diffuser opening, will secure the closely adjacent pair of main runners in a parallel relationship.

Although only a single embodiment has been depicted, it should be obvious that numerous modifications would be possible by one skilled in the art without departing from the spirit of the invention, the scope of which is limited by the following claims.

I claim:

1. A spacer comprising:

A body member having opposed ends;

A tab member perpendicularly depending from each of said opposed body member ends, one of said opposed tab members is of lesser width than the others; and locking means perpendicularly depending from each of said tab members, said locking means including a planar ear having a locking lip formed by a cut-out at one end thereof immediately adjacent the juncture of said ear and its associated tab member.

2. A device for spacing a pair of construction members in parallel relationship, said device comprising:

a relatively rigid plate member extending between said construction members; and means affixed to each of opposite ends of said plate member for releasably locking said plate member to each of said construction members, each said locking means including a tab member perpendicularly depending from each said end of said plate member, one of said tab members being of lesser width than the other, and a planar ear perpendicularly depending from each said tab member, each said ear having a locking lip formed by a cut-out at one end thereof immediately adjacent the juncture of said ear and its associated tab member.

* * * * *